United States Patent [19]

Hood

[11] 4,009,547

[45] Mar. 1, 1977

[54] PRECAST MONUMENT BASE

[75] Inventor: Clarence Francis Hood, Fairview, Pa.

[73] Assignee: Top Roc Precast Corporation, Erie, Pa.

[22] Filed: Dec. 10, 1975

[21] Appl. No.: 639,300

[52] U.S. Cl. ..... 52/294; 52/103; 52/365; 52/612; 52/396

[51] Int. Cl.[2] ..... E04C 2/04; E02D 27/00

[58] Field of Search ..... 52/38, 102, 103, 294, 52/396, 612, 365; 248/20, 22, 350

[56] References Cited

UNITED STATES PATENTS

| | | | |
|---|---|---|---|
| 2,095,290 | 10/1937 | Roy | 52/103 |
| 3,190,041 | 6/1965 | Kimball | 52/294 |
| 3,704,564 | 12/1972 | Koga | 52/309 |

FOREIGN PATENTS OR APPLICATIONS

| | | | |
|---|---|---|---|
| 565,299 | 10/1958 | Canada | 52/294 |

*Primary Examiner*—James L. Ridgill, Jr.
*Attorney, Agent, or Firm*—Oldham & Oldham Co.

[57] ABSTRACT

The invention relates to a precast monument base which is made from precast concrete, and is capable of being installed during any kind of weather conditions. The idea basically involves the utilization of a resilient layer between the base and the base cap to allow proper leveling, and to prevent the entrance of moisture to create problems under freezing conditions. The base extends below the frost line, and hence is not effected by freezing of the ground or excessive amounts of water or moisture.

5 Claims, 6 Drawing Figures

PRECAST MONUMENT BASE

BACKGROUND OF THE INVENTION

Heretofore, it has been known that normally monument bases are of concrete which is poured into the ground to form a suitable base with the concrete extending below the frost line. This type of work normally cannot be done during freezing or inclement weather because of the problems of pouring concrete under such conditions, as well as the problems of trying to install a base cap onto the base to effect mounting of the monument thereon. Hence, in northern climates it is impossible to install monuments during most of the winter months, and the installation, even under normal conditions, is relatively expensive, and a rather time-consuming endeavor.

OBJECTS OF THE INVENTION

Therefore, it is a general object of the present invention to avoid and overcome the foregoing and other difficulties of and objections to prior art practices by the provisions of a precast monument base which utilizes a precast concrete base extending well below the frost line that is adapted to be inserted into a hole dug in the ground by a workman, and which utilizes a resilient foam layer between the base and the base cap to allow for leveling and to prevent moisture problems.

A further object of the invention is to provide a simple, highly efficient, and yet inexpensive mounting for a monument, including a base and a base cap, which is very effective.

The aforesaid and other objects of the invention are achieved by providing a precast monument base comprising a precast concrete base member having considerable depth to extend well below the frost line when inserted into the ground, said base having a substantially large flat top surface, a relatively thick closed-cell foam layer secured to and substantially covering at least the top perimeter surface portion of the base member, a substantially rectangular-shaped base cap positioned on top of the foam layer, and means to adjust the level of the base cap with respect to the base member while the foam layer effects a resilient relationship therebetween.

For a better understanding of the invention, reference should be made to the accompanying drawings, wherein FIG. 1 is a front elevation of the base with the foam layer in position;

Figure 1:
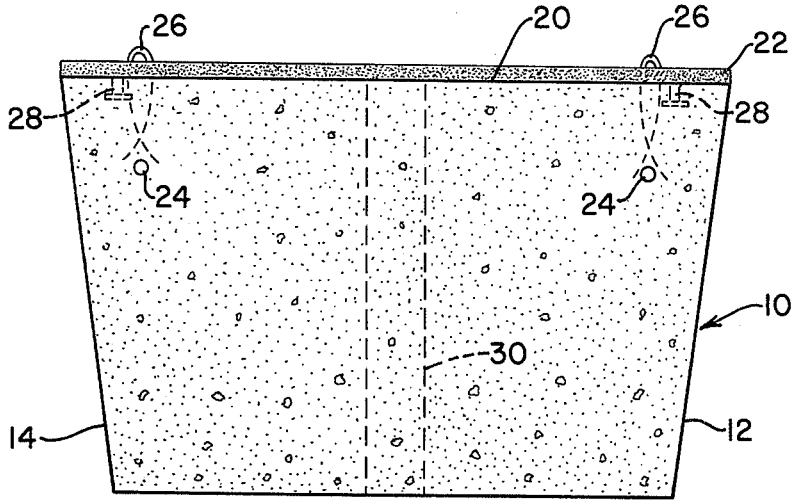

With respect to the form of the invention illustrated in the drawings, the numeral 10 illustrates a precast concrete base which incorporates tapered sides 12 and 14, which are tapered to facilitate positioning of the base into a hole dug into the ground, and also, of course, to allow for draft in the molding operation of the base from the precast concrete. It should be noted in FIG. 3 that the long sides 16 and 18 likewise are tapered for the same reasons. The base further defines a large flat top surface 20, which supports a foam layer 22 to be more fully defined hereinafter.

Figure 3:
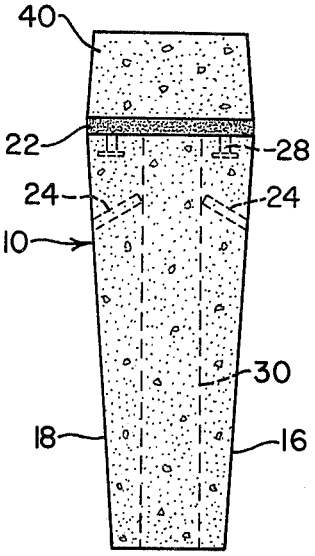
FIG. 3 is an end elevational view of the base of FIG. 1 with the foam layer intact.

In order to facilitate handling of the base 10, some 60° angled holes 24 are provided with the angle indicated in FIG. 3. These holes can receive bars, for example, to facilitate the handling of the base. Lifting loops 26 are provided to facilitate stripping the base 10 from its form upon molding. In addition, the top of the base incorporates four pipe sections 28 to provide the support for the leveling procedure for the base cap which will be defined hereinafter. Essentially, these are 1-inch long by 1-inch diameter pipe sections, tack welded to a 2-inch square by ⅝-inch thick flat base plate, and are actually molded into the precast base 10.

One other feature of the base 10 is a centrally positioned hole extending vertically throughout the height, indicated by numeral 30, which acts to allow water that possibly gets in between the base cap and the base to drain therethrough.

Figure 2:
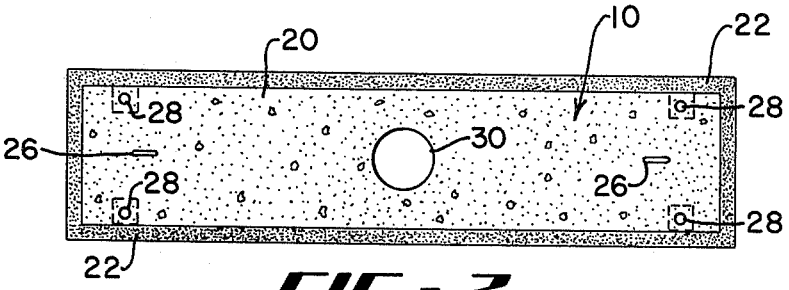
FIG. 2 is a top plan view of the base of FIG. 1 illustrating the relationship of the foam layer.

As best seen in FIG. 2 of the drawings, the foam layer 22 takes an essentially rectangular shape to define a full perimeter location on the top of the surface 20. The invention contemplates that this will be a neoprene closed-cell foam, so as to be essentially waterproof, and that it will be glued to the top of the base so that it is permanently attached and affixed thereto. The invention further contemplates that it be 1-inch by 1-inch square to give a sufficient thickness dimension, as well as a width dimension for the resilient supporting of the base cap defined hereinafter. It should be understood, however, that other dimensional arrangements than those indicated might be utilized, as well as different material for the foam layer, to still accomplish the basic purposes of the invention.

Figure 4:
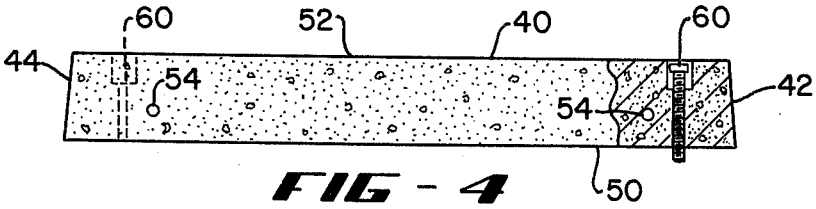
FIG. 4 is a front elevational view of the base cap illustrating the relationship of the leveling screws with respect thereto.
Figure 5:
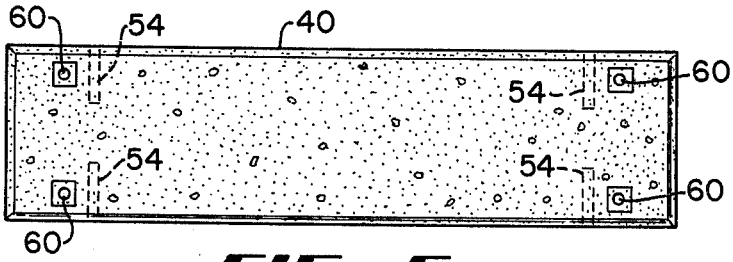
FIG. 5 is a top plan view of the base cap of FIG. 4.
Figure 6:
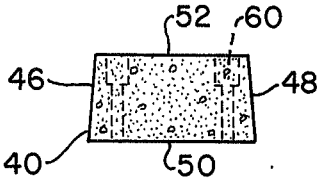
FIG. 6 is an end elevational view of the base cap of FIG. 4.

The base cap is illustrated in FIGS. 4–6, and it is indicated generally by numeral 40. The cap should be seen to comprise two ends 42 and 44, upwardly and inwardly sloped, as well as two longitudinal sides 46 and 48, as best seen in FIG. 6, sloped in the same way. Similarly, the base cap has a large flat bottom surface 50, and a large flat top surface 52. The outer dimensions of the bottom surface 50 are essentially exactly the same as the top dimensions of the surface 20 for the base 10, and hence when the base cap 40 is positioned onto the base, the surface 50 rests around its perimeter on the foam layer 22, all as best seen in FIG. 3 of the drawings.

The base cap similarly includes handling holes 54 for the same purpose as described with respect to the holes 24 of the base 10.

In order to then facilitate a leveling of the base cap 40, with respect to the base 10, threaded bolt holes are provided at the four corner locations of the cap, as best seen in FIG. 5, to receive bolts therethrough which can be screwed up and down then with respect to the base cap 40, with the ends of the bolts seating into the pipe sections 28 in the top of the base 10. The bolts are illustrated generally by numeral 60, and this structure allows each of the four corners of the base cap to be individually adjusted to achieve the leveling action desired. In essence, this ten is achieved because of the resiliently acting force of the foam layer 22, which will normally compress somewhat by the weight of the base cap, and of course, it is desired to have some compression so that in effect there is a seal between the bottom surface 50 of the base cap and the top of the foam layer 22, so that no water will normally get into the area because of the gasket-like seal caused by the neoprene foam layer 22.

Hence, it should be understood that the base cap is leveled by the bolts 60, with respect to the base, with a resilient engaging relationship between the base and the base cap by the neoprene layer 22. The fact that water is kept from between the base cap 40 and the base 10 by the neoprene layer 22 means that this installation can take place in the winter time. Even if some small amounts of water are present, the resilient mounting nature of the closed-cell foam, which cannot have water penetrate thereinto, still facilitates this winter mounting technique. The tapered relationship of the base 30 facilitates its being positioned into a hole, as a hole is normally dug with tapered sides, as the workman gets down further into the ground, and hence this is a very simple configuration to fit into most any hole dug for this purpose. The leveling arrangement allows for minor variations in the level of the top surface of base 10, as well as variations in the surface configuration between the surface 20 and the surface 50 of the respective base 10 and base cap 40.

Therefore, it should be understood that a preferred embodiment of the invention has been illustrated and described in detail in accordance with the patent statutes, but that the invention is not limited thereto or thereby, but that the inventive scope is defined in the appended claims.

What is claimed is:

1. A precast monument base comprising, a precast concrete base member having considerable depth to extend well below the frost line when inserted into the ground; said base having a substantially large flat top surface, a relatively thick closed-cell resilient foam layer secured to and substantially covering at least the periphery of the top surface of the base member, a substantially rectangular-shaped base cap resiliently positioned on top of the foam layer in operative alignment with the base member, and adjusting means positioned between the base cap and the base member to adjust the level alignment of and adjustably connect the base cap with respect to the base member while the foam layer effects a resilient mounting relationship therebetween.

2. A precast monument base according to claim 1 where the base member includes a longitudinally extending centrally positioned hole therein to facilitate draining of water from between the base member and the base cap.

3. A precast monument base according to claim 1 where the foam layer is made from a 1-inch square section of neoprene sufficient to resiliently support the base cap on the base member.

4. A precast monument base according to claim 3 where the means to adjust the level of the base cap with respect to the base member comprise a plurality of leveling bolts threadably received into the base cap and seating against the top of the base member.

5. A precast monument base according to claim 4 where the foam layer is adhesively secured to the base member.

* * * * *